US010028890B2

(12) United States Patent
Rhodes et al.

(10) Patent No.: US 10,028,890 B2
(45) Date of Patent: Jul. 24, 2018

(54) DUAL CONFIGURATION BOTTLE ASSEMBLY

(71) Applicant: Handi-Craft Company, St. Louis, MO (US)

(72) Inventors: Scott Rhodes, St. Louis, MO (US); Idus L. Rhodes, II, St. Louis, MO (US); Charles H. Miller, St. Louis, MO (US); Bernard J. Kemper, Bonne Terre, MO (US)

(73) Assignee: HANDI-CRAFT COMPANY, St. Louis, MO (US)

( * ) Notice: Subject to any disclaimer, the term of this patent is extended or adjusted under 35 U.S.C. 154(b) by 801 days.

(21) Appl. No.: 14/151,513

(22) Filed: Jan. 9, 2014

(65) Prior Publication Data

US 2014/0190922 A1 Jul. 10, 2014

Related U.S. Application Data

(60) Provisional application No. 61/751,005, filed on Jan. 10, 2013, provisional application No. 61/885,733, filed on Oct. 2, 2013.

(51) Int. Cl.
*A61J 9/02* (2006.01)
*A61J 9/04* (2006.01)
(Continued)

(52) U.S. Cl.
CPC ..... *A61J 9/04* (2013.01); *A61J 11/02* (2013.01); *A61J 11/045* (2013.01)

(58) Field of Classification Search
CPC ..... A61J 9/04; A61J 11/02; A61J 9/06
(Continued)

(56) References Cited

U.S. PATENT DOCUMENTS 2,822,102 A 2/1958 Holland
2,892,559 A 6/1959 Raiche
(Continued)

FOREIGN PATENT DOCUMENTS

CN 1054007 A 8/1991
GB 1070984 A1 6/1967
(Continued)

OTHER PUBLICATIONS

International Search Report and Written Opinion for PCT/US2014/010884, dated May 2, 2014, 13 pages.
(Continued)

*Primary Examiner* — Anthony Stashick
*Assistant Examiner* — Raven Collins
(74) *Attorney, Agent, or Firm* — Armstrong Teasdale LLP

(57) ABSTRACT

A bottle assembly includes a container having a liquid chamber defined therein, and a vent assembly positionable substantially entirely within the liquid chamber of the container. A collar assembly generally defines a closure for the container and is releasably engageable with a neck of the container. The collar assembly and the container are configured relative to each other to enable selective configuration between a first configuration in which the vent assembly is disposed substantially entirely within the liquid chamber of the container and a second configuration in which the vent assembly is omitted from the container.

19 Claims, 7 Drawing Sheets

(51) Int. Cl.
*A61J 11/02* (2006.01)
*A61J 11/04* (2006.01)

(58) Field of Classification Search
USPC ..... 215/11.1–11.5
See application file for complete search history.

(56) References Cited

U.S. PATENT DOCUMENTS

| | | | | |
|---|---|---|---|---|
| 3,545,637 | A | 12/1970 | Barr | |
| 3,834,570 | A | 9/1974 | Barr | |
| 3,838,784 | A | 10/1974 | Barton | |
| 4,279,353 | A | 7/1981 | Honma | |
| 4,386,696 | A | 6/1983 | Goncalves | |
| 5,087,287 | A | 2/1992 | Holmes, III | |
| 5,101,992 | A | 4/1992 | Serre | |
| 5,172,821 | A | 12/1992 | Knopf | |
| 5,244,105 | A | 9/1993 | Serre | |
| 5,316,160 | A | 5/1994 | Cautereels | |
| 5,779,071 | A * | 7/1998 | Brown | A61J 9/006 215/11.1 |
| 5,791,503 | A | 8/1998 | Lyons | |
| 6,450,367 | B1 | 9/2002 | Sittler | |
| 6,543,632 | B1 * | 4/2003 | McIntyre | A01K 9/00 119/72 |
| 7,743,952 | B2 | 6/2010 | Auer | |
| 7,828,165 | B2 | 11/2010 | Brown et al. | |
| 8,113,365 | B2 | 2/2012 | Brown et al. | |
| 8,146,759 | B2 | 4/2012 | Brown et al. | |
| 8,579,132 | B2 | 11/2013 | Wong | |
| 2004/0089626 | A1 | 5/2004 | Pyun | |
| 2005/0258124 | A1 | 11/2005 | Brown | |
| 2006/0124573 | A1 * | 6/2006 | Nachumi | A61J 9/006 215/11.5 |
| 2006/0213859 | A1 | 9/2006 | Sheu | |
| 2006/0243694 | A1 * | 11/2006 | McKendry | A47J 41/0061 215/11.1 |
| 2007/0262041 | A1 | 11/2007 | Smith | |
| 2008/0099422 | A1 * | 5/2008 | Rees | A61J 9/006 215/11.5 |
| 2008/0202950 | A1 | 8/2008 | Anderson | |
| 2008/0302793 | A1 | 12/2008 | Tirosh | |
| 2009/0014403 | A1 * | 1/2009 | Lu | A61J 9/04 215/11.5 |
| 2009/0071926 | A1 * | 3/2009 | Berkovitch | A61J 9/04 215/11.4 |
| 2011/0068078 | A1 | 3/2011 | Brown et al. | |
| 2011/0079570 | A1 | 4/2011 | Brown | |
| 2011/0309047 | A1 * | 12/2011 | Fucito | A61J 9/04 215/11.5 |
| 2013/0048591 | A1 * | 2/2013 | Morrone | A61J 9/001 215/11.5 |

FOREIGN PATENT DOCUMENTS

| | | |
|---|---|---|
| JP | 62-160940 | 10/1987 |
| JP | 48-70992 | 2/2012 |
| KR | 20070054575 A | 5/2007 |
| TW | M296703 U | 9/2006 |
| WO | 2006048878 A1 | 5/2006 |
| WO | 2011095971 A1 | 8/2011 |

OTHER PUBLICATIONS

Extended European Search Report for 14737993.7, dated Aug. 8, 2016. 8 pages.
Office Action issued in connection with Chinese Patent Application No. 2014800037589, dated Jul. 3, 2017.

* cited by examiner

DUAL CONFIGURATION BOTTLE ASSEMBLY

CROSS REFERENCE TO RELATED APPLICATIONS

This application claims the benefit of U.S. Provisional Patent Application No. 61/751,005 filed Jan. 10, 2013, and U.S. Provisional Patent Application No. 61/885,733 filed Oct. 2, 2013, which are hereby incorporated by reference in their entirety.

FIELD

The field of this invention relates generally to bottle assemblies and more particularly to a bottle assembly including a collar assembly allowing configuration in at least two different assembled configurations.

BACKGROUND

Bottle assemblies, such as infant or nursing bottle assemblies, typically have multiple components including a bottle, a nipple, a collar for securing the nipple to the bottle (the nipple and collar sometimes collectively defining a collar assembly), and a cap for covering the nipple when the bottle is not in use. The nipple typically has one or more openings for allowing liquid contained within the bottle to exit through the nipple and into an infant's mouth for consumption by the infant (or young child). During use, the infant places an end of the nipple in their mouth and sucks on the nipple to withdraw the liquid contained within the bottle.

At least some bottle assemblies include a removable vent assembly that can be positioned within the bottle. Some examples of vented bottle assemblies include those available from Handi-Craft Company under the trade name Dr. Brown's. Additional examples are disclosed in U.S. Pat. No. 5,779,071 issued Jul. 14, 1998, U.S. Pat. No. 7,828,165 issued Nov. 9, 2010, U.S. Pat. No. 8,113,365 issued Feb. 14, 2012, and U.S. Pat. No. 8,146,759 issued Apr. 3, 2012, the disclosures of all of which are herein incorporated by reference in their entirety. In these bottle assemblies, the vent assembly allows air to enter the bottle while the infant consumes the liquid through the nipple, thus alleviating or reducing the formation of a vacuum within the bottle during nursing. The vent assembly typically seats, at least in part, on the rim of the bottle and a collar assembly including a collar and nipple are together threadably secured down over the vent assembly to external threads on the neck of the bottle.

Some users may at times assemble such a bottle with the vent assembly omitted from the bottle, such as when traveling or when a child is older and parent decides to no longer use the vent assembly. In such an instance, the collar assembly is threaded onto the neck of the bottle until the collar is tightened down as much as possible. However, the neck of the bottle and the height of the collar are such that the collar assembly, and in particular the nipple of the collar assembly, do not adequately seal down against the rim of the bottle. As such, leakage of liquid from the bottle can occur.

There is a need, therefore, for a bottle assembly, and in particular a vented bottle assembly, in which the vent assembly can be removed and the bottle assembly still used without the risk of leakage.

SUMMARY

In one aspect, a bottle assembly comprises a container having an open end, a closed end, a base portion, and a neck together defining a liquid chamber of the container. The neck comprises a rim defining the open end of the container. The bottle assembly also comprises a vent assembly that is positionable substantially entirely within the liquid chamber of the container to enable venting of the container during use. A collar assembly generally defines a closure for the container and is configured for releasable engagement with the neck of the container over the open end thereof. The collar assembly and the container are configured relative to each other to enable selective configuration of the bottle assembly between a first configuration in which the vent assembly is disposed substantially entirely within the liquid chamber of the container and a second configuration in which the vent assembly is omitted from the container.

In another aspect, a bottle assembly generally comprises a container having an open end, a closed end, a base portion, and a neck. The neck comprises a rim defining the open end of the container. A vent assembly is positionable on the rim of the container to enable venting of the container during use. A collar assembly generally defines a closure for the container and is configured for releasable engagement with the neck of the container over the open end thereof. The collar assembly and the container are configured relative to each other to enable selective configuration of the bottle assembly between a first configuration and a second configuration. In the first configuration, the collar assembly is configured to sealingly engage the vent assembly and urge the vent assembly into sealing engagement with the rim of the container. In the second configuration, in which the vent assembly is omitted from the bottle assembly, the collar assembly is configured to sealingly engage the rim of the container.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
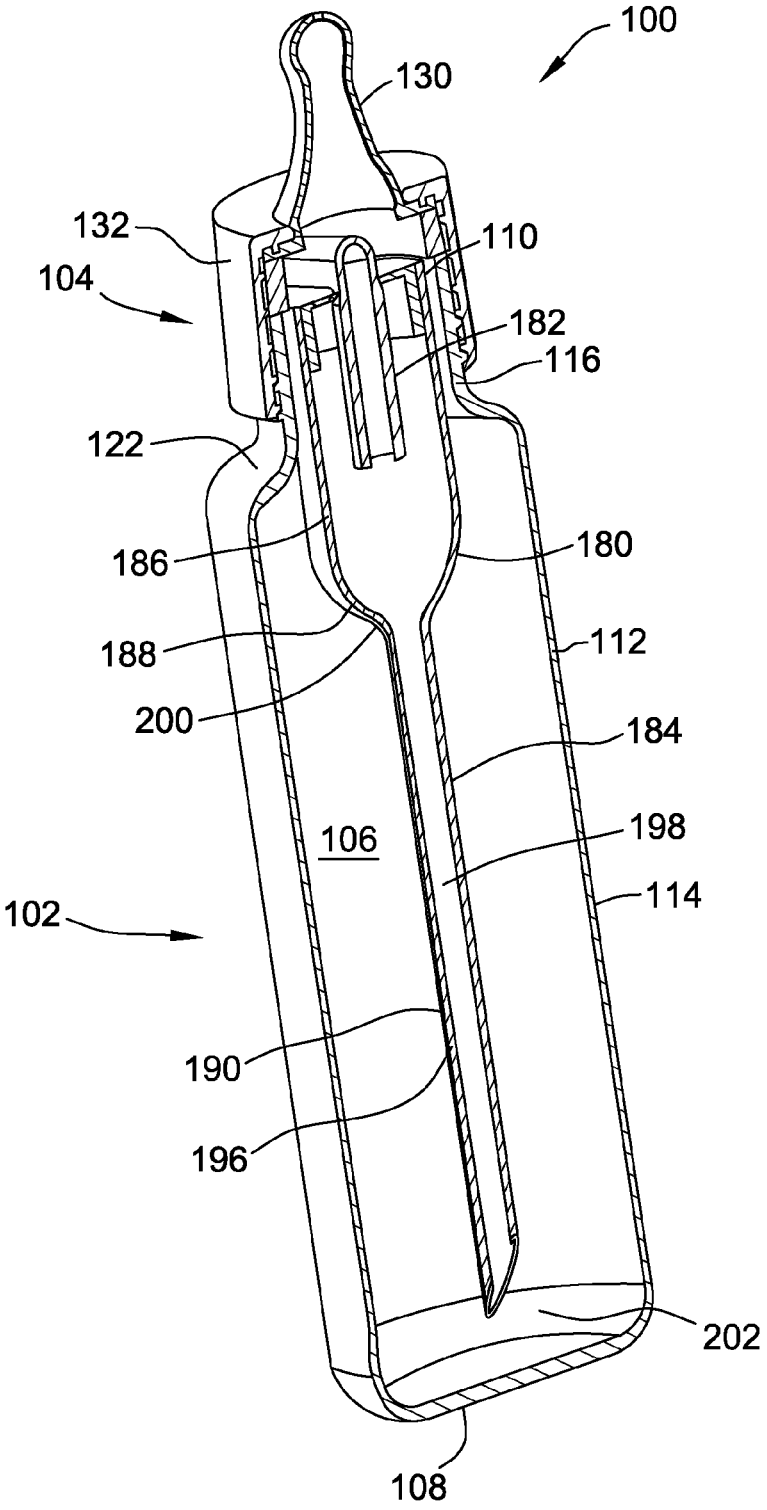
FIG. 1 is a perspective cross-section of one embodiment of a nursing bottle assembly including a vent assembly.
Figure 2:
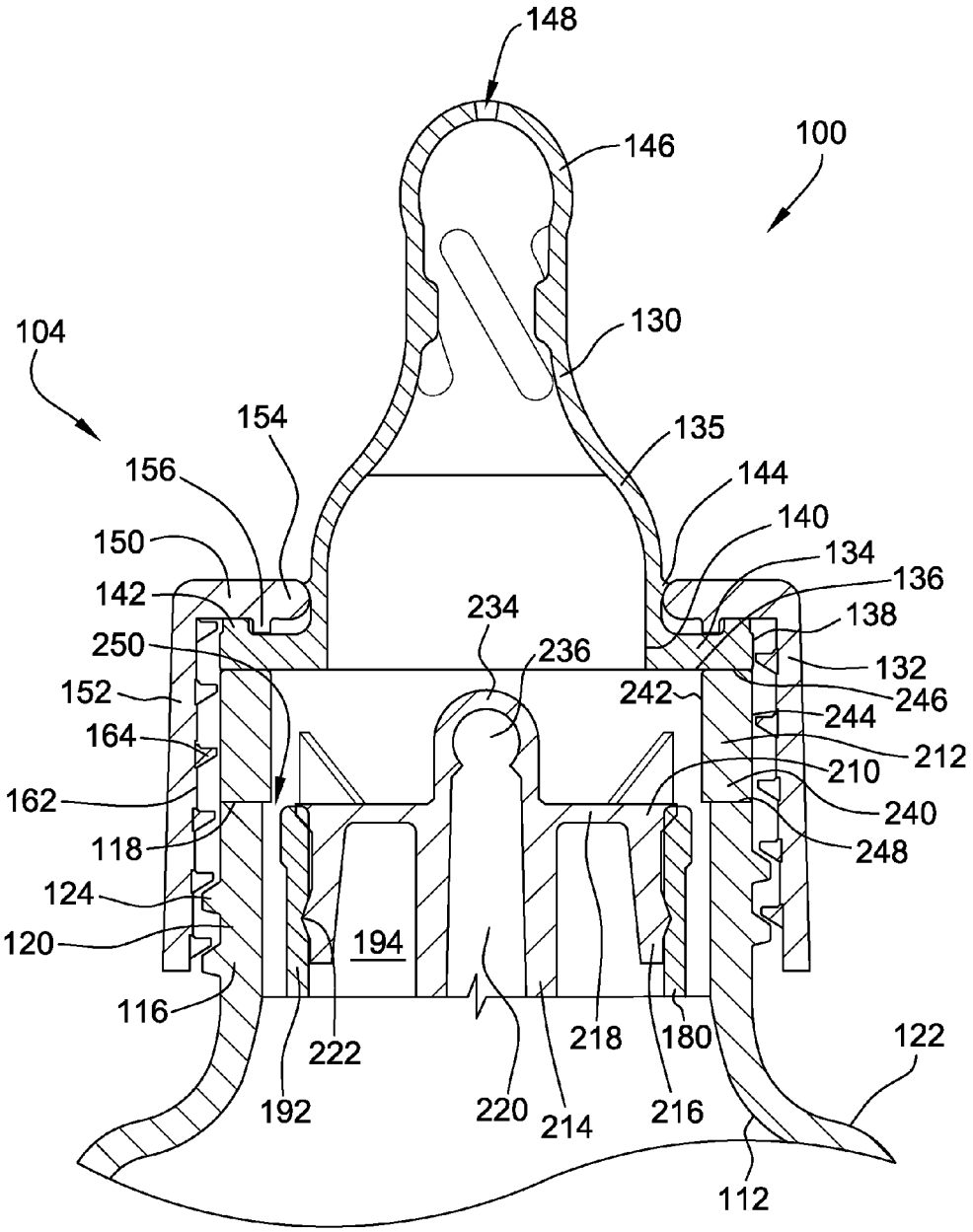
FIG. 2 is an enlarged cross-section of a portion of the bottle of FIG. 1 with the vent assembly included.
Figure 3:
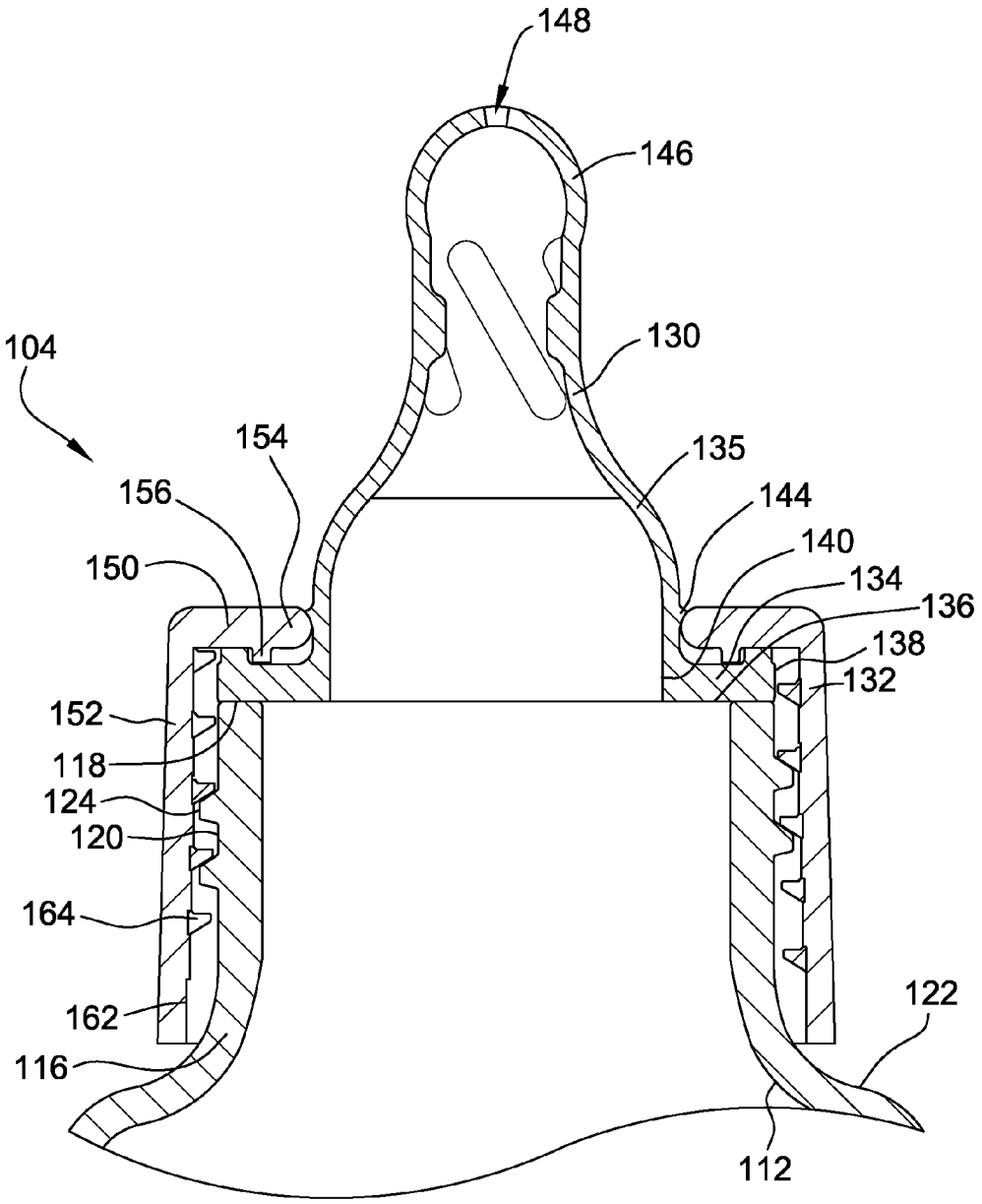
FIG. 3 is an enlarged cross-section of a portion of the bottle of FIG. 1 with the vent assembly omitted.

Referring now to the drawings and in particular to FIGS. 1-3, a bottle assembly, generally indicated at 100, includes a container 102 such as bottle and more particularly a nursing bottle in the illustrated embodiment, and a collar assembly, generally indicated at 104 for generally closing the bottle. The container 102 includes a liquid chamber 106 defined therein and adapted to hold a quantity of liquid for consumption by a user, such as a nursing infant. It is also understood that the container 102 may be configured other than as illustrated herein, and may be configured for use other than as a nursing bottle assembly, such as a sports bottle, a drink tumbler, a training cup, a commuter cup, etc. The container 102 may be made of any suitable material such as, without limitation, glass, polypropylene or other plastic, aluminum, or stainless steel. The container 102 can also be made in any desired color or colors, and may be transparent, translucent, or opaque.

The container 102 has a closed bottom 108, an open top 110, and a generally cylindrical side wall 112 extending between the closed bottom 108 and the open top 110. The cylindrical side wall 112 includes a base portion 114 and a neck 116 that is narrowed with respect to the base portion 114. That is, the neck 116 has a smaller diameter than the base portion 114. It is understood that in other embodiments the neck 116 diameter may only be slightly smaller than the diameter of the base portion 114, or even the same diameter as the base portion, without departing from the scope of this invention. The neck 116 includes an annular rim 118, an externally threaded portion 120, and a shoulder 122 defined at the transition between the neck 116 and the base portion 114. The threaded portion 120 includes threads 124 for assembling the container 102 to the collar assembly 104 as described later herein.

The collar assembly 104 of the bottle 100 is adapted for removable attachment to the container 102 for selectively holding a nipple 130 on the container 102. The illustrated collar assembly 104 includes the nipple 130 and a collar 132. The nipple 130 and the collar 132 can each be made of any suitable material. In one embodiment, for example, the nipple 130 is made of a substantially pliable material such as at least one of a rubber material, a silicone material, and a latex material, and the collar 132 is made of polypropylene. The nipple 130 and the collar 132 can be made in any desired color or colors, and may be transparent, translucent, or opaque.

In the illustrated embodiment of FIGS. 2 and 3, the nipple 130 includes a nipple portion 135 and a transversely extending flange 134. The nipple flange 134 includes a bottom face 136 that extends from a generally circular outer edge 138 to a generally circular inner edge 140. In the illustrated embodiment, a peripherally extending lip 142 projects up from the flange generally adjacent the circular outer edge 138. In at least some alternative embodiments, the nipple 130 does not include a peripherally extending lip 142. The nipple portion 135 extends up from the flange 134 generally adjacent the circular inner edge 140 thereof. As illustrated in FIG. 2, the nipple portion 135 includes an annular external projection 144 that projects radially outward. The nipple portion 135 also includes an outlet end 146 including an aperture 148 for dispensing liquid to the user. It is contemplated, however, that the nipple 130 can have different shapes and sizes than those illustrated and described herein without departing from the present invention.

The illustrated collar 132 has an annular top panel 150 and a depending side wall 152. The top panel 150 includes an annular projection 156 that extends downward from the underside of the panel proximate an annular nub or radially inner edge margin 154 of the top panel 150. The edge margin 154 and the annular projection 156 facilitate assembly of the nipple 130 on the collar 132. To assemble the collar assembly 104, the nipple 130 is pulled, nipple portion 135 first, up through the central opening in the top panel 150 of the collar 132 until edge margin 154 is positioned below the annular external projection 144 of the nipple 130, and the annular projection 156 of the collar 132 is positioned radially inward of the peripheral lip 142 of the nipple 130. It is understood, however, that the nipple 130 and collar 132 may be configured other than as illustrated and still otherwise configured for assembly together for further assembly onto the container 102. It is also contemplated that in other embodiments the nipple 130 and collar 132 need not be capable of being held in assembly for conjoint assembly onto the container 102.

The side wall 152 of the collar 132 has an inner surface 162 with suitable internal threads 164 for threaded engagement with the external threads 124 of the neck 116 of the container 102 to releasably secure the collar and hence the collar assembly 104 on the container 102. In one particularly suitable embodiment, as illustrated in FIG. 2, the number of threads 164 on the inner surface 162 of the collar side wall 152 exceeds the number of external threads 124 on the neck 116 of the container, the purpose of which will become apparent. In one embodiment, for example, the collar 132 may have approximately twice as many internal threads 164 as the number of external threads 124 on the neck 116 of the container 102.

With reference to FIGS. 1 and 2, the bottle assembly 100 also includes a vent assembly 180 to permit venting of the bottle assembly during use. In FIG. 3, the vent assembly 180 is omitted. The vent assembly 180, as illustrated in FIG. 1, includes a vent insert 182 and a receptacle portion 184. The receptacle portion 184 is releasably attachable to the vent insert 182, such as by friction fit in a manner known in the art. The receptacle portion 184 includes a top 186, a middle portion 188, and a vent tube 190. The top 186 includes a generally cylindrical side wall 192 that defines a reservoir 194 therein. The vent tube 190 includes a generally cylindrical side wall 196 that has a smaller diameter than the side wall 192 of the top 186. The side wall 196 of the vent tube 190 defines a passage 198 that is in fluid communication with the reservoir 194. The middle portion 188 includes a tapered side wall 200 that extends between the vent tube side wall 196 and the top side wall 192. The vent tube 190 also includes an air outlet 202 at an end of the passage 198 proximate the closed bottom 108 of the container 102.

The vent insert 182 includes an inner portion 210 and an outer portion 212. The inner portion 210 includes an internal vent tube 214, a lip 216, and a top wall 218 extending between and oriented orthogonal to the internal vent tube 214 and lip 216. The internal vent tube 214 defines a passage 220 in flow communication with the reservoir 194. To assemble the vent insert 182 to the receptacle portion 184, the lip 216 is configured to engage the side wall 192 of the receptacle portion 184. For example, in one embodiment, the lip 216 includes a bulge 222 that engages the side wall 192. Alternatively, the vent insert 182 and the receptacle portion 184 may be integrally formed with each other. The inner portion 210 of the vent insert 182 further includes a lateral vent 234 extending upward from the top wall 218 to define a channel 236 within the vent insert 182.

The outer portion 212 of the vent insert 182 includes a perimeter wall 240. The perimeter wall 240 includes an inner edge 242, an outer edge 244, a top 246, and a bottom 248. The perimeter wall 240 has at least one vent (not shown) such that the channel 236 extends through the perimeter wall 240. A gap 250 defined between the perimeter wall 240 and the top wall 218 enables liquid in the liquid chamber 106 to flow towards the nipple 130. It is contemplated, however, that the components of the vent assembly 180 can have different shapes and sizes than those illustrated and described herein without departing from some aspects of this invention. Similar vent assemblies are known in the art, such as those used on the bottle assemblies disclosed in U.S. Pat. No. 5,779,071 issued Jul. 14, 1998, U.S. Pat. No. 7,828,165 issued Nov. 9, 2010, U.S. Pat. No. 8,113,365 issued Feb. 14, 2012, and U.S. Pat. No. 8,146,759 issued Apr. 3, 2012. Accordingly, additional details and operation of the vent assembly 180 is not described further herein.

As illustrated in FIGS. 2 and 3, the collar side wall 152 and the container neck 116 are suitably sized relative to each other to permit operation of the bottle assembly 100 in two different configurations, a first configuration (FIG. 2) in which the vent assembly 180 is included and a second configuration (FIG. 3) in which the vent assembly is omitted. For example, in the illustrated embodiment, the length (or height in the orientation of the drawings herein) of the container neck 116 (e.g., from the rim 118 of the container 102 to the shoulder 122 where the neck widens outward to the base portion 114 of the container) is sufficient to accommodate the side wall 152 of the collar in the second configuration, i.e., when the vent assembly is omitted as illustrated in FIG. 3.

Accordingly, as seen in FIG. 2, in the first configuration, where the bottle assembly 100 includes the vent assembly 180, the vent assembly 180 is inserted into the container 102 such that the bottom 248 of the perimeter wall 240 seats down against the rim 118 of the container. After the vent assembly 180 is inserted within the container 102, the collar assembly 104 is attached to the container 102 by threadably engaging the internal collar threads 164 with the external threads 124 of the neck 116 and rotating the collar 132 to twist the collar down onto the container. As the collar 132 is tightened onto the container 102, the bottom face 136 of the nipple 130 is urged against the top 246 of the perimeter wall 240 of the vent assembly 180 to seal the nipple (and hence the collar assembly 104) against the vent assembly. Concurrently, the bottom 248 of the perimeter wall 240 of the vent assembly is urged against the rim 118 of the container 102 to seal the vent assembly against the container.

In this configuration, some of the lower threads 164 of the collar engage the threads 124 of the neck, while the uppermost collar threads oppose the perimeter wall 240 of the vent assembly. As illustrated in FIG. 2, the collar side wall 152 is sufficiently long such that in the first configuration the lower end of the collar side wall extends below the lowermost threads 124 of the neck 116 so that no external threads are visible when the collar assembly 104 is secured to the container 102.

In the second configuration, illustrated in FIG. 3, the vent assembly 180 is omitted from the bottle assembly 100. When the collar assembly 104 is tightened down onto the container 102 in this configuration, the collar threads 164 engage the threads 124 of the neck 116 of the container and the collar 132 is rotated to twist the collar down onto the container until the nipple 130 is urged against the rim 118 of the container to seal the nipple directly against the container. In this configuration, a lower set of the collar threads is disposed below the lowermost external thread 124 of the neck 116. In this manner, the lower end of the collar 132 is disposed well below the lowermost external thread 124 and nearer to the shoulder 122 of the container.

Figure 4:
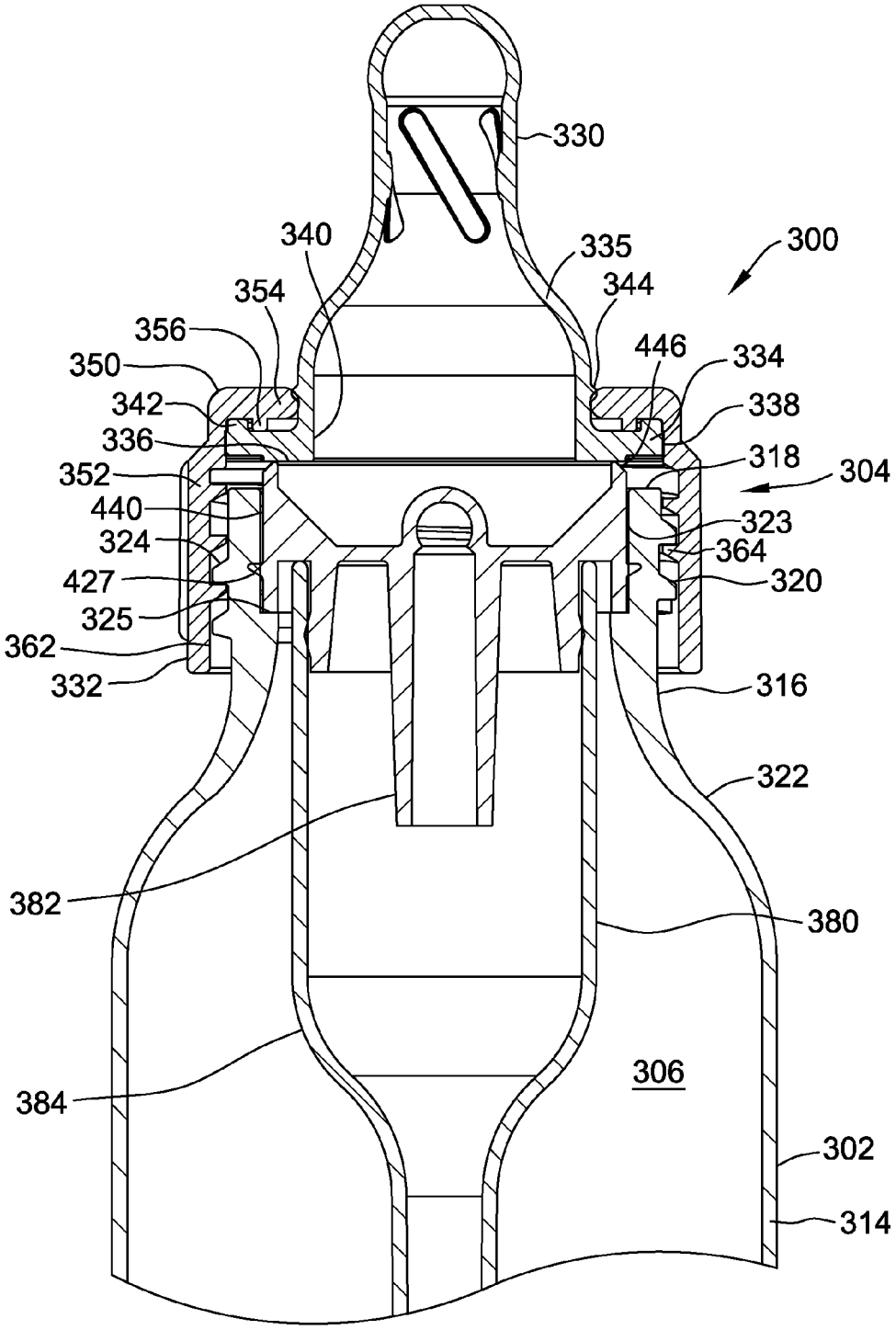
FIG. 4 is a cross-section of an enlarged portion of a second embodiment of a nursing bottle assembly.
Figure 5:
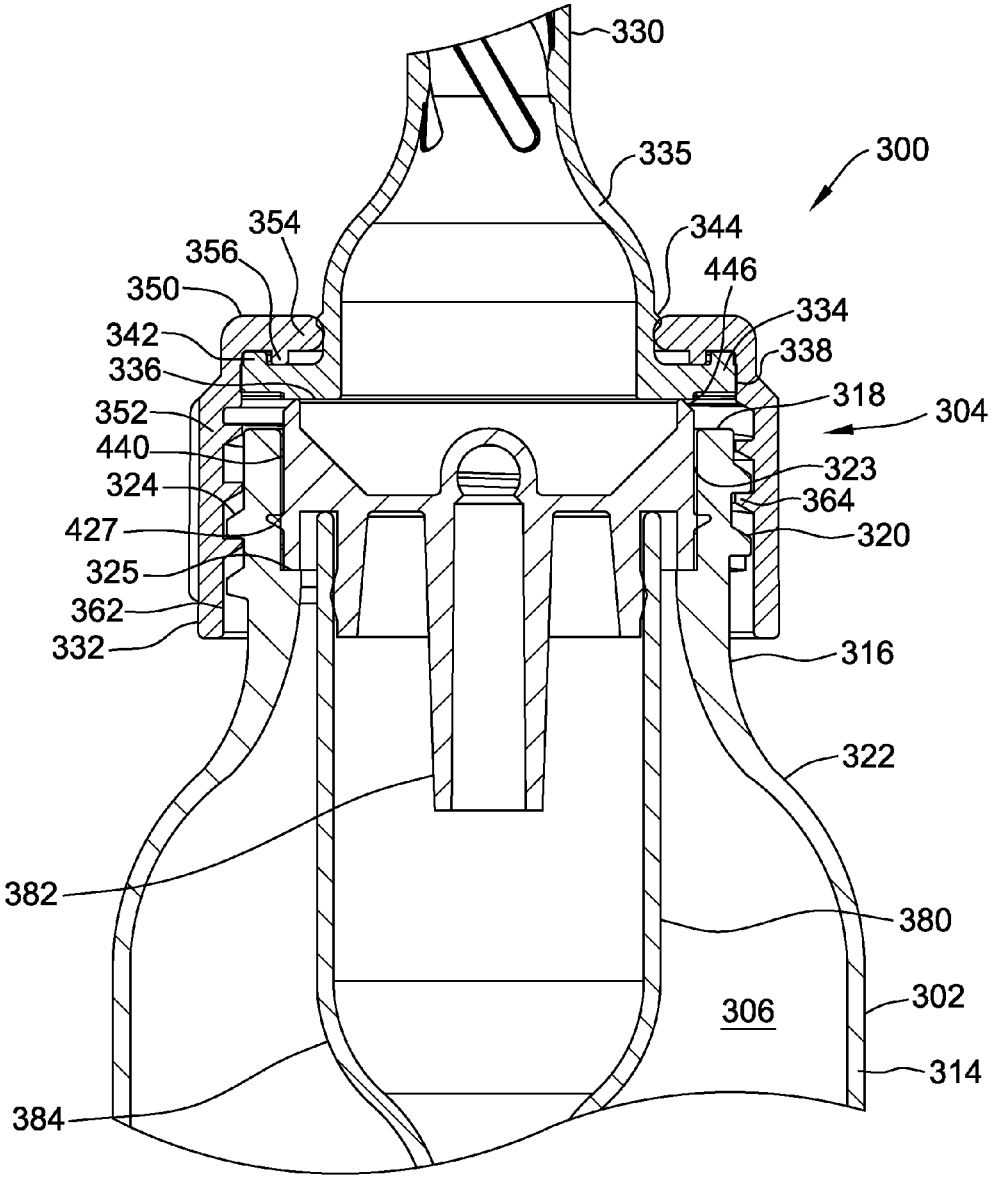
FIG. 5 is a further an enlarged view of the cross-section of FIG. 4.

FIGS. 4 and 5 illustrate a second embodiment of a nursing bottle assembly, indicated generally at 300, similar to the nursing bottle assembly 100 of FIGS. 1-3 in that it includes a container 302 comprising a liquid chamber 306, and collar assembly, generally indicated at 304 comprised of a nipple 330 and collar 332 for selectively holding the nipple on the container. The nursing bottle assembly 300 further comprises a vent assembly 380 including a vent insert 382 and receptacle portion 384. The receptacle portion 384 is releasably attachable to the vent insert 382 in the same manner as for the vent assembly 180 of the embodiment of FIGS. 1-3. In this embodiment, however, substantially the entire vent assembly 380 and in particular the vent insert 382 is disposed substantially entirely within the liquid chamber 306 of the container 302 (e.g., in the neck 316 of the container).

As illustrated in FIGS. 4 and 5, the neck 316 of the container 302 includes an annular rim 318, an externally threaded portion 320, and an external shoulder 322 defining a transition between the neck 316 and a base portion 314 of the container. The threaded portion 320 includes threads 324 for assembling the container 302 to the collar assembly 304. An inner surface 323 of the neck 316 of the container 302 has a stepped inner diameter that defines an inner shoulder 325 for supporting the vent insert 382 within the neck of the container.

The nipple 330 includes a nipple portion 335 and a transversely extending flange 334 having a bottom face 336 that extends from a generally circular outer edge 338 to a generally circular inner edge 340. In the illustrated embodiment, a peripherally extending lip 342 projects up from the flange 334 generally adjacent the circular outer edge 338. In at least some alternative embodiments, the nipple 330 does not include a peripherally extending lip 342. The nipple portion 335 extends up from the flange 334 generally adjacent the circular inner edge 340 thereof. As illustrated in FIG. 4, the nipple portion 335 includes an annular external projection 344 that projects radially outward. It is contemplated, however, that the nipple 330 can have different shapes and sizes than those illustrated and described herein without departing from the present invention.

The illustrated collar 332 has an annular top panel 350 and a depending side wall 352. The top panel 350 includes an annular projection 356 that extends downward from the underside of the top panel proximate an annular nub or radially inner edge margin 354 of the top panel 350. The edge margin 354 and the annular projection 356 facilitate assembly of the nipple 330 on the collar 332. To assemble the collar assembly 304, the nipple 330 is pulled, nipple portion 335 first, up through the central opening in the top panel 350 of the collar 332 until the edge margin 354 is positioned below the annular external projection 344 of the nipple 330, and the annular projection 356 of the collar 332 is positioned radially inward of the peripheral lip 342 of the nipple 330. It is understood, however, that the nipple 330 and collar 332 may be configured other than as illustrated and still otherwise configured for assembly together for further assembly onto the container 302. It is also contemplated that in other embodiments the nipple 330 and collar 332 need not be capable of being held in assembly for conjoint assembly onto the container 302.

The side wall 352 of the collar 332 has an inner surface 362 with suitable internal threads 364 for threaded engagement with the external threads 324 of the neck 316 of the container 302 to releasably secure the collar 332 and hence the collar assembly 304 to the container 302.

The vent insert 382 of the vent assembly 380 includes a perimeter wall 440 having an annular bulge 427 that sealingly engages the inner surface 323 of the neck 316 of the container 302 just above the inner shoulder 325. It is understood that in other embodiments the annular bulge 427 may be located on the perimeter wall 440 of the vent insert 382 to sealingly engage the inner surface 323 of the neck 316 at a position spaced further above the inner shoulder 325 without departing from the scope of this invention.

The perimeter wall 440 of the vent insert 382 is suitably long enough (e.g., in height in the orientation of FIGS. 4 and 5) such that when the vent insert 382 is seated on the inner shoulder 325 of the neck 316 of the container 302, a top 446 of the vent insert 382 extends sufficiently above the rim 318 of the container 302 so as to engage the nipple 330 upon assembly of the nursing bottle assembly 300. The top 446 of the vent insert 382 also holds the nipple 330 high enough to prevent the nipple from forming an airtight seal against the rim 318 of the container 302.

By configuring the vent assembly 380 and more particularly the vent insert 382 to be disposed substantially entirely within the liquid chamber 306 of the container 302, no bottle-specific nipple 330 and collar 332 are needed. For example, in the illustrated embodiment of FIGS. 4 and 5, upon assembly of the nursing bottle assembly 300 in a first configuration in which the vent insert 382 is used, the vent insert (with the receptacle portion 384 attached thereto) is disposed in the container 302 with the vent insert seated on the inner shoulder 325 of the inner surface 323 of the container. The collar assembly 304 (i.e., the nipple 330 and collar 332) is attached to the container 302 by threadably engaging the collar with the external threads 324 of the neck 316 of the container and rotating the collar to twist the collar down onto the container. As the collar 332 is tightened onto the container 302, the bottom face 336 of the nipple 330 seals against the top 446 of the perimeter wall 440 of the vent insert while allowing air to enter the container between the nipple and the rim 318 of the container.

In a second configuration (not shown) of the nursing bottle assembly 300, the vent assembly 380 is omitted. But in this embodiment the collar assembly 304 is attached to the container 302 in the same manner as in the first configuration. Accordingly, the collar 332 of this second embodiment need not be configured to fit on the container differently in the second configuration than in the first configuration.

Figure 6:
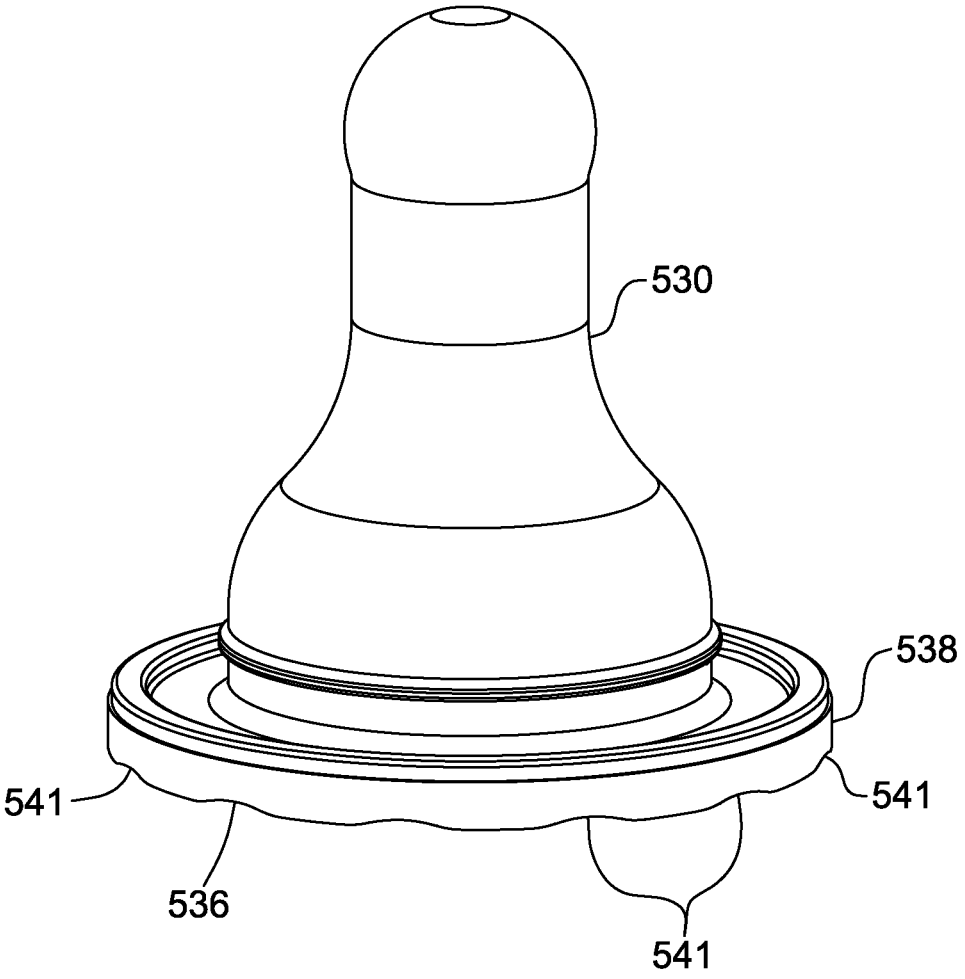
FIG. 6 is side elevation a second embodiment of a nipple suitable for use with the bottle assembly of FIGS. 1-3 or with the bottle assembly of FIGS. 4 and 5.
Figure 7:
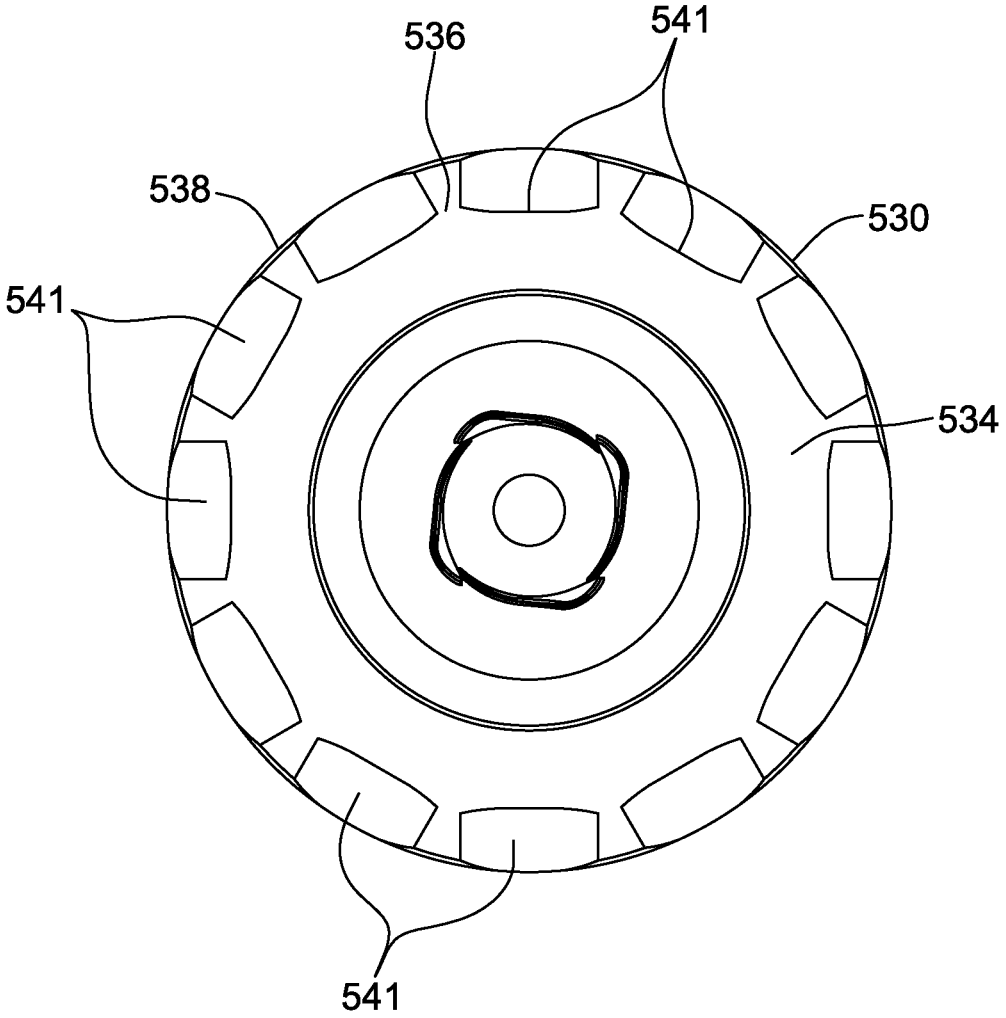
FIG. 7 is a bottom view of the nipple of FIG. 6.

FIGS. 6 and 7 illustrate a second embodiment of a suitable nipple 530 for use with the nursing bottle assemblies 100, 300 of the first and second embodiments herein. The nipple 530 is similar to the nipple 130 of FIGS. 1-3 and the nipple 330 of FIGS. 4 and 5, with the exception of the configuration of the bottom face 536. In this embodiment, a bottom face 536 of the nipple 530 has a plurality of vent features 541 extending radially inward from an outer edge margin 538 of the flange 534 of the nipple 530 in equal, circumferentially spaced relationship with each other. As best seen in FIG. 7, the illustrated vent features 541 comprise a plurality of arcuate (in circumferential extension) channels that extend radially inward from the outer edge margin 538 of the nipple flange 534. It is understood that in other embodiments the vent features 541 may be configured to have any other suitable shape. It is also contemplated that the vent features 541 may instead comprises radially extending slits formed in the bottom face 536 of the nipple 530.

The vent features 541 are suitably sized in length (e.g., in the radial direction), such that when the nipple 530 is used in the nursing bottle assembly 100 of the embodiment of FIGS. 1-3, the vent features 541 do not extend radially inward of the vent insert 182 in the first configuration of the bottle assembly (e.g., with the vent assembly 180 in place) so that the vent insert 182 seals against the bottom face 536 of the nipple 130 radially inward of the vent features 541. But in the second configuration of the bottle assembly 100 the bottom face 536 of the nipple 530 contacts the rim 118 of the container 102 with the vent features 541 extending radially inward of the rim 118 of the container 102 so that air can still enter the container 102 via the vent features 118.

Likewise, in the nursing bottle assembly 300 of FIGS. 4 and 5, in the first configuration of the bottle assembly (with the vent assembly 380 in place) the top 446 of the perimeter wall 440 of the vent insert 382 seals against the bottom face 536 of the nipple radially inward of the vent features 541 (e.g., so that air enters the container 302 only through the vent assembly 380). In the second configuration of the bottle assembly 300 the bottom face 536 of the nipple 530 contacts the rim 318 of the container 302 with the vent features 541 extending radially inward of the rim 318 of the container 302 so that air can still enter the container 302 via the vent features 541.

When introducing elements of the present invention or the various versions, embodiment(s) or aspects thereof, the articles "a", "an", "the" and "said" are intended to mean that there are one or more of the elements. The terms "comprising", "including" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above without departing from the scope of the invention, it is intended that all matter contained in the above description and shown in the accompanying drawings shall be interpreted as illustrative and not in a limiting sense.

What is claimed is:

1. A bottle assembly comprising:

a container having an open end, a closed end, a base portion, and a neck together defining a liquid chamber within the container, the neck having a rim defining the open end of the container;

a vent assembly positionable substantially entirely within the liquid chamber of the container to enable venting of the container during use; and a collar assembly generally defining a closure for the container, the collar assembly configured for releasable engagement with the neck of the container over the open end thereof, the collar assembly defining an outlet aperture for dispensing liquid from the liquid chamber, wherein the collar assembly and the container are configured relative to each other to enable selective configuration of the bottle assembly between a first configuration in which the vent assembly is disposed substantially entirely within the liquid chamber of the container and a second configuration in which the vent assembly is omitted from the container, at least one of the collar assembly and the container being configured for venting the container to atmosphere other than through the outlet aperture in the second configuration with the vent assembly omitted from the container, wherein the vent assembly forms a seal against the neck of the container when the bottle assembly is in the first configuration; wherein the neck of the container comprises an inner surface including a shoulder, the shoulder configured to support the vent assembly within the container during use.

2. The bottle assembly set forth in claim 1 wherein the vent assembly comprises a vent insert having a perimeter wall, the perimeter wall comprising a bulge configured to sealingly engage the inner surface of the neck of the container.

3. The bottle assembly set forth in claim 1 wherein a top of the vent assembly extends above the rim of the neck when the vent assembly is seated on the shoulder of the neck of the container.

4. The bottle assembly set forth in claim 3 wherein the collar assembly comprises a collar and a nipple.

5. The bottle assembly set forth in claim 4 wherein the collar comprises an annular nub and an annular projection, and the nipple comprises an external projection and a peripheral lip, the external projection of the nipple configured to retain the annular nub of the collar, and the peripheral lip of the nipple configured to retain the annular projection of the collar to couple the nipple to the collar for conjoint assembly onto the container.

6. The bottle assembly set forth in claim 4 wherein in the first configuration of the bottle assembly the nipple sealingly engages the vent assembly, and wherein in the second configuration of the bottle assembly the nipple sealingly engages the rim of the neck of the container.

7. A bottle assembly comprising:

a container having an open end, a closed end, a base portion, and a neck together defining a liquid chamber within the container, the neck having a rim defining the open end of the container;

a vent assembly positionable substantially entirely within the liquid chamber of the container to enable venting of the container during use, wherein the neck of the container comprises an inner surface including a shoulder, the shoulder configured to support the vent assembly within the container during use, wherein a top of the vent assembly extends above the rim of the neck when the vent assembly is seated on the shoulder of the neck of the container; and a collar assembly generally defining a closure for the container, the collar assembly configured for releasable engagement with the neck of the container over the open end thereof, wherein the collar assembly comprises a collar and a nipple, wherein the collar assembly and the container are configured relative to each other to enable selective configuration of the bottle assembly between a first configuration in which the vent assembly is disposed substantially entirely within the liquid chamber of the container and a second configuration in which the vent assembly is omitted from the container, at least one of the collar assembly and the container being configured for venting the container to atmosphere in the second configuration with the vent assembly omitted from the container, wherein the nipple comprises a flange having a bottom face, the bottom face of the flange comprising a plurality of vent features extending radially inward from an outer edge of the flange in an equal, circumferentially-spaced relationship with each other.

8. The bottle assembly set forth in claim 7 wherein the plurality of vent features comprises arcuate channels that extend radially inward from the outer edge of the flange.

9. The bottle assembly set forth in claim 7 wherein the plurality of vent features extends radially inward of the rim of the neck of the container but does not extend radially inward of the top of the vent assembly, such that in the first configuration of the bottle assembly the vent assembly sealingly engages the bottom face of the nipple radially inward of the vent features, and such that in the second configuration of the bottle assembly the plurality of vent features engages the rim of the container so that air can enter the container by the plurality of vent features.

10. A bottle assembly comprising:

a container having an open end, a closed end, a base portion, and a neck, the neck having a rim defining the open end of the container;

a vent assembly positionable on the rim of the container to enable venting of the container during use; and a collar assembly generally defining a closure for the container, the collar assembly configured for releasable engagement with the neck of the container over the open end thereof, wherein the collar assembly and the container are configured relative to each other to enable selective configuration of the bottle assembly between a first configuration and a second configuration, wherein in the first configuration, the collar assembly is configured to sealingly engage the vent assembly and urge the vent assembly into sealing engagement with the rim of the container, and wherein in the second configuration, in which the vent assembly is omitted from the bottle assembly, the collar assembly is configured to sealingly engage the rim of the container, at least one of the collar assembly and the container being configured for venting the container to atmosphere in the second configuration with the vent assembly omitted from the container.

11. The bottle assembly set forth in claim 10 wherein the neck of the container comprises external threads thereon, and wherein the collar assembly comprises internal threads for threaded engagement with the external threads of the neck of the container.

12. The bottle assembly set forth in claim 11 wherein the number of internal threads on the collar assembly is greater than the number of external threads on the neck of the container.

13. The bottle assembly set forth in claim 12 wherein the number of internal threads on the collar assembly is at least two times the number of external threads on the neck of the container.

14. The bottle assembly set forth in claim 10 wherein the collar assembly comprises a collar and a nipple.

15. The bottle assembly set forth in claim 14 wherein the collar comprises an annular nub and an annular projection, and wherein the nipple comprises an external projection and a peripheral lip, the external projection configured to retain the annular nub, and the peripheral lip configured to retain the annular projection to couple the nipple to the collar for conjoint assembly onto the container.

16. The bottle assembly set forth in claim 14 wherein in the first configuration of the bottle assembly the nipple sealingly engages the vent assembly, and wherein in the second configuration of the bottle assembly the nipple sealingly engages the rim of the container.

17. The bottle assembly set forth in claim 16 wherein the container further comprises a liquid chamber, the vent assembly configured to extend at least in part into the liquid chamber of the container.

18. The bottle assembly set forth in claim 14 wherein the nipple comprises a flange having a bottom face, the bottom face of the flange comprising a plurality of vent features extending radially inward from an outer edge of the flange in an equal, circumferentially-spaced relationship with each other.

19. The bottle assembly set forth in claim 10 wherein the neck of the container has a first height extending from a shoulder of the container to the rim thereof, the collar assembly comprises a side wall disposed in opposed relationship to the neck of the container upon engagement of the collar assembly with the neck of the container, the side wall of the container having a second height, the second height being one of equal to and less than the first height of the neck of the container.

* * * * *